United States Patent [19]

Bastenhof

[11] Patent Number: 4,467,483

[45] Date of Patent: Aug. 28, 1984

[54] PNEUMATIC WAVE GENERATOR

[75] Inventor: Dirk Bastenhof, Langerak, Netherlands

[73] Assignee: Ecopool Design Limited, Channel Islands

[21] Appl. No.: 469,521

[22] Filed: Feb. 24, 1983

[30] Foreign Application Priority Data

Oct. 8, 1982 [NL] Netherlands ..... 8203906

[51] Int. Cl.[3] ..... E04H 3/18; E02B 3/00

[52] U.S. Cl. ..... 4/491; 405/79; 137/596

[58] Field of Search ..... 405/79–81, 405/87, 52; 4/491, 505, 508, 494; 137/596.18, 596

[56] References Cited

U.S. PATENT DOCUMENTS

| | | | |
|---|---|---|---|
| 715,758 | 12/1902 | Cooper | 137/596.18 X |
| 2,056,855 | 10/1936 | Herz | 4/491 |
| 3,005,207 | 10/1961 | Matrai | 4/491 |
| 3,350,724 | 11/1967 | Leigh | 4/491 |
| 3,629,877 | 12/1971 | Schuster | 4/491 |
| 3,789,612 | 2/1974 | Richard et al. | 405/79 |
| 3,977,027 | 8/1976 | Speck | 4/491 |
| 4,276,661 | 7/1981 | Baker | 405/79 X |

FOREIGN PATENT DOCUMENTS

| | | | |
|---|---|---|---|
| 161548 | 9/1979 | Netherlands | 405/79 |

*Primary Examiner*—Dennis L. Taylor
*Attorney, Agent, or Firm*—Weingarten, Schurgin, Gagnebin & Hayes

[57] ABSTRACT

A pneumatic wave generator for a surf pool, comprising a caisson divided into a plurality of wave generating chambers, and a ventilator space with a source of compressed air capable of alternately effecting aspiration and expiration above the water surfaces in the wave generating chambers via a conduit system provided with air inlet and air outlet valves. According to the invention, in each of the wave generating chambers, the air inlet valve and the air outlet valve are coupled together and provided with a common drive.

10 Claims, 8 Drawing Figures

PNEUMATIC WAVE GENERATOR

This invention relates to a pneumatic wave generator for a swimming pool with artificial wave generation, referred to herein as a surf pool, and comprising a caisson divided into a plurality of wave generating chambers, and a ventilator space with a source of compressed air capable of alternately effecting aspiration and expiration above the water surfaces in the wave generating chambers via a conduit system provided with air inlet and air outlet valves.

Such a wave generator is known from Netherlands Pat. No. 161,548. The particular feature of this prior wave generator is that the maximum wave heights are located in the middle of the swimming pool. Apart from the number of wave generating chambers of a given width, this is achieved by virtue of a swivel channel forcing air alternately into two adjacent wave generating chambers. For this purpose these swivel channels are reciprocated by a pneumatically controlled linkage. As this reciprocation must be effected at a high rate, and a relatively high mass is involved, a relatively high amount of power is required. Moveover it is not a simple matter to blow air into two adjacent wave generating chambers simultaneously, should this be desired to generate a particular wave pattern.

In this specification the term "aspiration" means the process in which the space above the water in the wave generating chambers is charged with compressed air from the blower, and the term "expiration" means the process in which excess air is let off from the wave generating chambers under the influence of the pressure of the water in the pool.

It is an object of the present invention to make the prior wave generator of simpler and hence of less expensive design, and yet provide more possibilities for varying the wave pattern. According to the invention, this is achieved, in principle, by virtue of the fact that, in each of the wave generating chambers the air inlet walve and the air outlet valve are coupled together and provided with a common drive.

This principle can be implemented in several ways.

A first embodiment is characterized in that the air inlet valve and the air outlet valve of a wave generating chamber both have a circular aperture in which a butterfly-valve member is provided, the two butterfly-valve members being mounted on a common drive shaft connected to suitable drive means. The rotation of just the butterfly-valve members requires considerably less power than swivelling a swivel channel, as is effected in the prior apparatus.

A second embodiment is characterized in that, in each wave generating chamber, the air inlet valve has an aperture of suitable shape, and the air outlet valve consists of two halves located on opposite sides of said air inlet valve, with, preferably, the valve cover of the air inlet valve being connected by a tensional connecting element to a suitable drive and the valve cover halves of the air outlet valve being connected by tensional connecting elements to the valve cover of the air inlet valve.

The tensional connecting elements may consist of ropes. The drive may suitably consist of servo cylinders.

The most preferred embodiment of the apparatus according to the invention is characterized in that the conduit system for the aspiration and expiration of the wave generating chamber is integrated with said chambers in a wall of the surf pool, and together with said chambers is built from the material used for the other walls of said pool.

This preferred embodiment may be further characterized in that the front wall of the wave generating chambers, which front wall extends from a side wall of the pool to an opposite side wall, extends from the roof of the wave generating chamber and the conduit system located behind it to a point spaced some distance from the bottom of the pool, so that water can pass between said front wall and said bottom, and that the rear wall of the wave generating chambers is spaced some distance from the rear wall of the pool to create an interspace therebetween, which interspace is divided by a plate extending substantially horizontally into two parts, the upper part of which serves as an expiration duct, and the lower part of which serves as an aspiration duct, a source of compressed air being provided beside said ducts outside the pool sidewall concerned, said source being connected at least to said aspiration duct.

In a highly suitable form of this embodiment, the cross-sectional area of the expiration duct is greater than the cross-sectional area of the aspiration duct.

In apparatus designed in this way, there may be associated with each wave generating chamber, channels in the wall between said chamber and the aspiration duct and the expiration duct, respectively, which channels are arranged to be shut off by the air inlet valve and the air outlet valve, respectively.

Some embodiments of the invention will now be described, by way of example, with reference to the accompanying drawings. In said drawings, FIG. 1 shows a cross-sectional view of a ventilator space and caisson of a surf pool;

Figure 1:
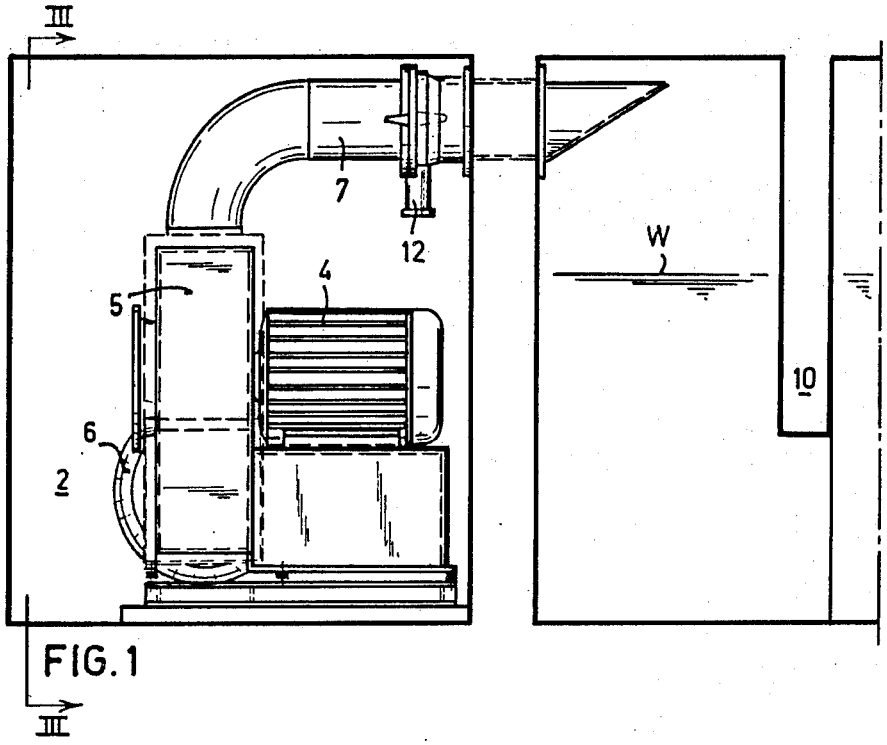
Figure 2:
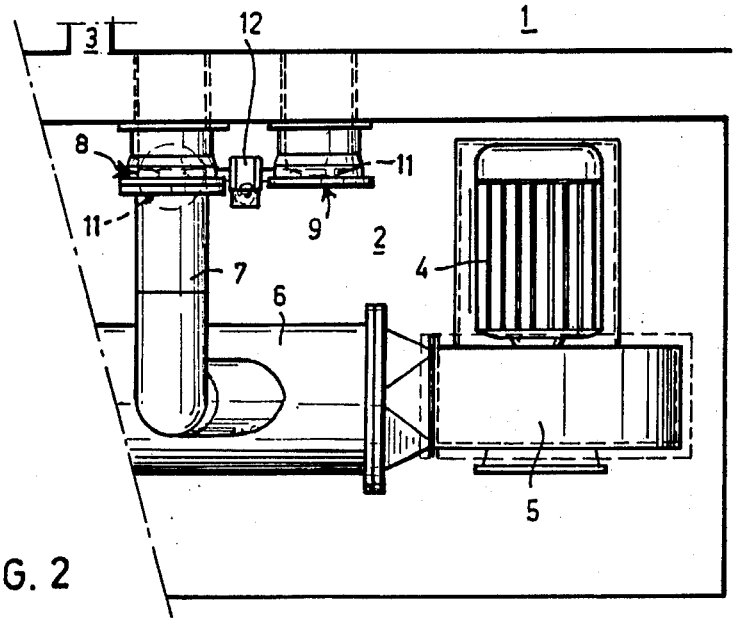
FIG. 2 is a plan view of the showing of FIG. 1.
Figure 3:
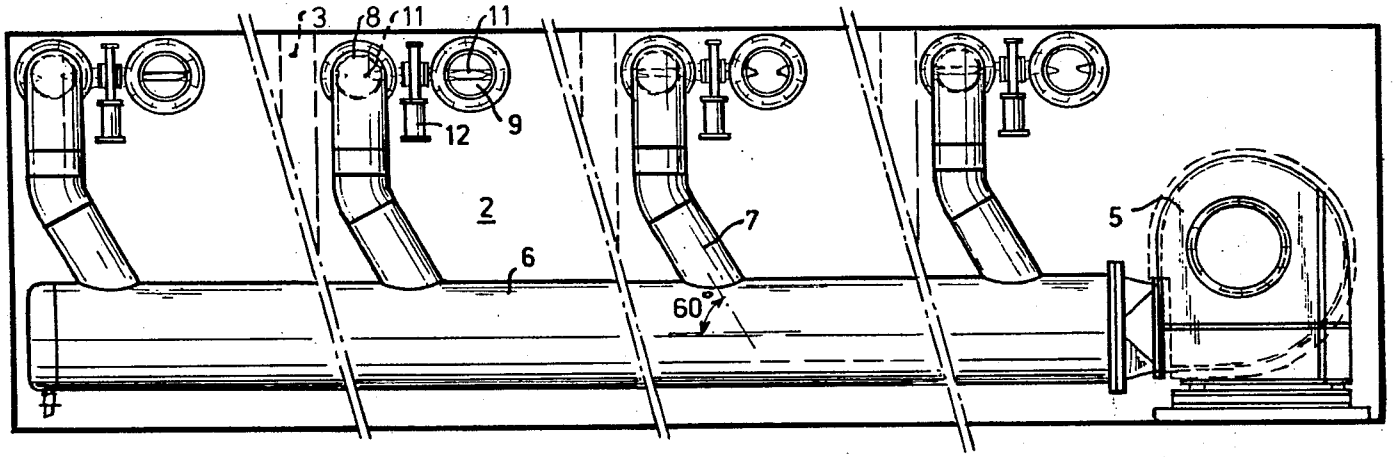
FIG. 3 is an elevational view according to the arrow III—III of FIG. 1.

The wave generator shown in FIGS. 1–3 comprises a caisson 1 and a ventilator space 2.

Caisson 1 is divided by a plurality of partitions 3 into wave generating chambers. Ventilator space 2 comprises a blower 5 driven by a motor 4 and capable of supplying compressed air to a duct 6 having branches 7, the number of which is equal to the number of wave generating chambers, or a multiple thereof, inasmuch as, with large wave generating chambers, for example, more branches may terminate in one chamber.

The compressed air can pass via an air inlet valve 8, if it is the "open" position, into the wave generating chamber, for this valve is located in front of a duct through the caisson wall, and this at such a level above the water level W that during the expiration via an air outlet valve wall 9 located just beside the air inlet valve, the water cannot overflow through said valve into the ventilator space. When the blower ventilator during the aspiration phase, forces the water level W in FIG. 1 downwards, this level must not be allowed to be lowered to such an extent that the air can escape under the caisson front wall 10.

In the embodiment of FIGS. 1-3, valves 8 and 9 are provided with butterfly-valve members 11 mounted on a shaft at right angles to each other. When they are rotated by the common drive 12, it is possible to switch rapidly from aspiration to expiration or the other way round.

When the chambers are alternately supplied with air, the water levels in the wave generating chambers are decreased and increased in phase with the load exercised by the air, the water quantities are varied accordingly, and outside the front wall 10 of the caisson the water surface in the immediately adjacent area of the swimming pool assumes a wave configuration as viewed in the transverse direction.

Figure 4:
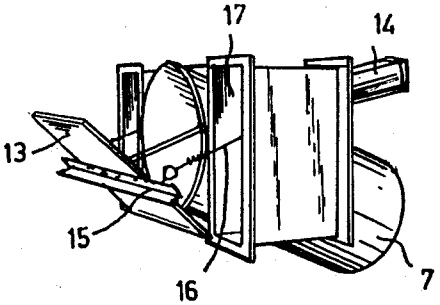
FIG. 4 is a perspective view of an air inlet and air outlet valve, as viewed from a wave generating chamber, and in the position for aspiration of the chamber.
Figure 5:
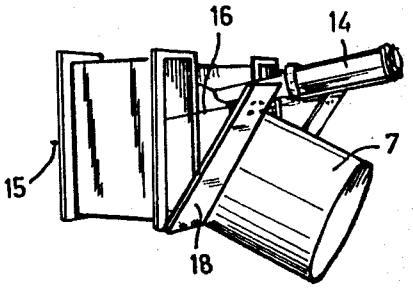
FIG. 5 is a perspective view of an air inlet and air outlet valve, as viewed from the ventilator space, and in the position for expiration of the chamber.

FIGS. 4 and 5 show a variant of the valves, in which the air inlet valve only consist of a rectangular valve cover 13, which can be pulled shut by a pneumatic cylinder 14 against the air pressure in the conduit system 6, 7. Provided on valve cover 13 is a profile 15 for fastening ropes 16 extending through the two air outlet valve halves 17, located on opposite sides of branch 7, to the free ends of the associated valve cover halves 18. Both valve cover 13 and valve cover halves 18 are mounted for pivoting movement about their lower edges. When air is being blown into the wave generating chamber (aspiration—FIG. 4), ropes 16 pull valve cover halves 18 shut. When valve cover 13 is closed by being pulled shut by pneumatic cylinder 14 (FIG. 5), air is blown out of the wave generating chamber (expiration), by virtue of the valve cover halves being automatically opened by the air pressure in the wave generating chamber.

Figure 6:
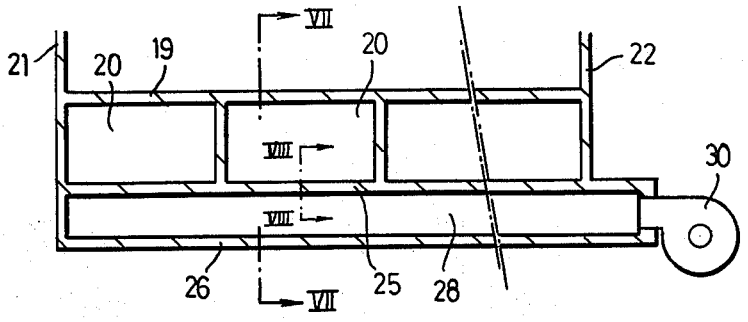
FIG. 6 is a cross-sectional view of the most preferred embodiment of the apparatus according to the invention.
Figure 7:
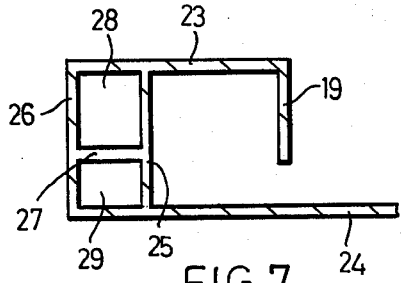
FIG. 7 is a vertical sectional view, taken on the line VII—VII of FIG. 6.

FIG. 6 shows a horizontal cross-sectional view of the most preferred embodiment (best mode) of the apparatus according to the invention. In this embodiment, the wave generating chambers and the conduit system for aspiration and expiration are fully integrated in a wall of the surf pool, and built from the same material as used for the walls of the pool, for example, concrete. FIG. 7 shows a vertical section through the relevant part of the surf pool, taken on the line VII—VII of FIG. 6.

In this preferred embodiment, the front wall 19 of the wave generating chambers 20, which front wall 19 extends from the side wall 21 of the pool to the side wall 22, extends from the roof 23 of the wave generating chambers 21 and the conduit system located behind it to a point spaced some distance from the bottom 24 of the pool, so that water can pass between front wall 19 and bottom 24. Rear wall 25 of the wave generating chambers 20 is spaced some distance from the rear wall 26 of the pool, to create an interspace therebetween, which interspace is divided by a horizontal plate 27 into two halves. The upper part 28 serves as an expiration duct, and the lower part 29 serves as an aspiration duct. Beside ducts 28 and 29, there is disposed a compressor 30, connected in a suitable manner to these ducts, and in any case, to the aspiration duct 29 for propelling air through it to the wave generating chambers 20. The cross-sectional area of the expiration duct 28, and hence the volume thereof, is greater than that of the aspiration duct 29. It is thus prevented that there is constantly a higher pressure in the wave generating chambers 20 than in the free space outside these chambers. A larger cross-sectional area of duct 28 is desirable for the purpose because the pressure to be exercised for the aspiration by means of the compressor will commonly be higher than the pressure to be exercised for the expiration by the swimming pool water.

The alternating aspiration and expiration of the wave generating chambers 20 is effected by alternately opening and closing valves coupled together with each chamber. The construction of these valves and the operation thereof will be described hereinafter. The aspiration and the expiration of the various chambers 20 is effected in such a sequence as to generate a desired wave form in the surf pool. The sequence of aspiration and expiration and the rhythm is which this is effected can be controlled by operating the systems of valves per chamber in that sequence and in that rhythm. This can be effected, for example, electronically by means of computer control. Any person skilled in the art knows how this can be realized. This manner of operation does not, by itself, form part of the present invention, and therefore needs no further description.

Figure 8:
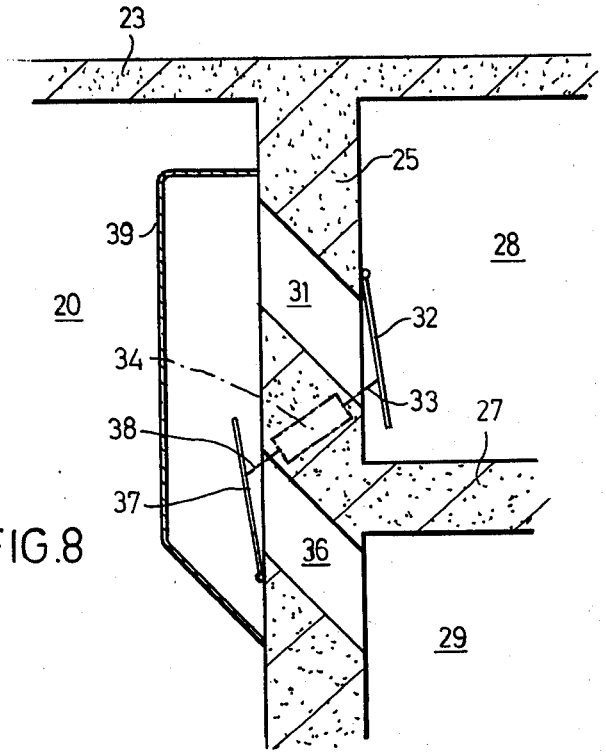
FIG. 8 shows a similar cross-sectional view, taken on the line VIII—VIII of FIG. 6.

FIG. 8 shows a cross-sectional view, taken on the line VIII—VIII of the apparatus illustrated in FIG. 6 at the point where the air inlet valve and the air outlet valve for the relevant wave generating chamber 20 are disposed. In the wall 25 which forms the rear wall of chamber 20, there is provided a duct 31 between chamber 20 and expiration conduit 28. Duct 31 can be shut off by valve cover 32, which via rope 33 is connected to servo cylinder 34. Similarly, in wall 25, there is provided a duct 36 between chamber 30 and aspiration conduit 29, which duct 36 can be shut off with valve cover 37, which by means of rope 38 is connected to servo cylinder 34. Cylinder 34 operates valves 32 and 37 in such a manner that when one valve is open, the other is closed. In front of ducts 31 and 36, an open-topped splash hood 39 may be arranged, which will prevent water from entering conduits 28 and 29 through these ducts.

Instead of a direct duct 36 in wall 25 between aspiration conduit 29 and chamber 20, use may be made of a duct passed through wall 27 between conduits 28 and 29, and terminating via an aperture the top of wall 25 in chamber 20. In that embodiment the air inlet valve may be arranged in front of the aperture last mentioned.

I claim:

1. A pneumatic wave generator for a surf pool, comprising a caisson divided into a plurality of wave generating chambers, and a ventilator space with a source of compressed air capable of alternately effecting aspiration and expiration above the water surfaces in the wave generating chambers via a conduit system provided with air inlet and air outlet valves, characterized in that, in each of the wave generating chambers, the air inlet valve (8,13,37) and the air outlet valve (9,18,32) are coupled together and provided with a common drive (12,14, 34).

2. A wave generator according to claim 1, characterized in that the air inlet valve and the air outlet valve of a wave generating chamber both have a circular aperture in which a butterfly-valve member (11) is provided, the two butterfly-valve members being mounted on a common drive shaft connected to suitable drive means.

3. A wave generator according to claim 1, characterized in that, in each wave generating chamber, the air inlet valve has an aperture (7) of suitable shape, and the air outlet valve consists of two halves (17) located on opposite sides of the air inlet valve.

4. A wave generator according to claim 3, characterized in that the valve cover (13) of the air inlet valve is connected by a tensional connecting element to a suitable drive (14) and that the valve cover halves (18) of the air outlet valve are connected by tensional connecting elements (16) with the valve cover (13) of the air inlet valve.

5. A wave generator according to claim 4, characterized in that the tensional connecting elements are ropes.

6. A wave generator according to claim 1, characterized in that the drive of an air inlet valve and an air outlet valve of a wave generating chamber is a servo cylinder.

7. A wave generator according to claim 1, characterized in that the conduit system for the aspiration and expiration of the wave generating chambers is integrated with said chambers in a wall of the surf pool, and together with said chambers is built from the material used for the other walls of said pool.

8. A wave generator according to claim 7, characterized in that the front wall of the wave generating chambers, which front wall extends from a side wall from the pool to an opposite side wall, extends from the roof of the wave generating chamber and the conduit system located behind it to a point spaced some distance from the bottom of the pool, so that water can pass between said front wall and said bottom, and that the rear wall of the wave generating chambers is spaced some distance from the rear wall of the pool to create an interspace therebetween, which interspace is divided by a plate extending substantially horizontally into two parts, the upper part of which serves as an expiration duct, and the lower part of which serves as an aspiration duct, a source of compressed air being provided beside said ducts outside the pool sidewall concerned, said source being connected at least to said aspiration duct.

9. A wave generator according to claim 8, characterized in that the cross-sectional area of the expiration duct is greater than the cross-sectional area of the aspiration duct.

10. A wave generator according to claim 8, characterized in that, associated with each wave generating chamber, there are provided channels in the wall between said chamber and the aspiration duct and the expiration duct, respectively, and the channels are arranged to be shut off by the air inlet valve and the air outlet valve, respectively.

* * * * *